United States Patent [19]

Durieux

[11] Patent Number: 4,843,743

[45] Date of Patent: Jul. 4, 1989

[54] PORTABLE MOTORIZED SHOVEL

[76] Inventor: Jules Durieux, Ruelle de Thuin 20, B-6558 Lobbes, Belgium

[21] Appl. No.: 240,219

[22] Filed: Sep. 6, 1988

[30] Foreign Application Priority Data

Sep. 3, 1987 [BE] Belgium ..... 08700991

[51] Int. Cl.[4] ..... E02F 5/02

[52] U.S. Cl. ..... 37/103

[58] Field of Search ..... 37/103, 130, 129, 284, 37/285, 265; 294/53.5, 54.5, 55

[56] References Cited

U.S. PATENT DOCUMENTS 887,874 5/1908 Toy ..... 37/130

2,590,143 3/1952 Adams, Jr. et al. ..... 37/278

4,302,894 12/1981 Emma ..... 37/130

*Primary Examiner*—Eugene H. Eickholt

*Attorney, Agent, or Firm*—Fishman, Dionne & Cantor

[57] ABSTRACT

A portable motorized shovel is presented which comprises a frame having an articulated arm. The frame supports a motor and is provided with handles. The articulated arm of the shovel includes a pole fastened to the frame at a pivot point and a shovel stem pivoted on the free end of the pole. One end of the stem includes a rockable blade and the other end of the stem (which extends beyond the pivot point on the pole) is pivoted on a nut adapted to move on a worm driven by the motor.

12 Claims, 2 Drawing Sheets

PORTABLE MOTORIZED SHOVEL

BACKGROUND OF THE INVENTION

This invention relates to a portable motorized shovel of small dimensions. The present invention is particularly well suited for earthmoving work.

Patent Document EP-A-O No. 189 008 discloses a known small mechanical shovel which is pivotally mounted on a running chassis and controlled by an articulated arm operated by hydraulic means. The running chassis is equipped with wheels which are guided by two handles and provided with a tiltable platform intended for the operator. However, this apparatus is rather complicated, cumbersome and heavy. In addition, while it permits a wide range of operations, it is also rather expensive.

Patent Document FR-A-No. 2 503 764 discloses a known hydraulically operated vehicle, particularly a small evacuating or loading shovel, which is provided with a driving lever and at least one prop consisting of a sole plate articulatd on a support arm. The driving lever is equipped with a Bowden control intended for operating a hydraulic control console. However, this patent does not describe a mechanical shovel or a control mechanism for such a shovel.

Other prior art documents relating to mechanical shovels and/or to control mechanisms for mechanical shovels include U.S. Pat. Nos. 1,474,314; 2,416,826; GB-A-No. 776,848; FR-A-No. 1,511,564; U.S. Pat. Nos. 3,589,538; 4,095,752 and 1,822,338. However, all of these prior devices are complicated and intended for fairly large earthmoving tasks. Moreover, none of the documents mention portable motorized shovels.

SUMMARY OF THE INVENTION

The present invention relates to a portable motorized shovel of small dimensions and low weight. In accordance with the present invention, a shovel of simplified construction is provided which makes it possible to carry out loading and unloading and/or excavation operations in a fairly easy manner.

In accordance with the present invention, the portable motorized shovel comprises a frame which is equipped with an articulated arm. The frame supports a motor and is provided with handles. The articulated arm consists of a pole fastened to the frame at a pivot point and a shovel stem pivoted on the free end of the pole. One end of the stem is equipped with a rockable blade and its other end, which extends beyond the pivot point on the pole, is pivoted on a nut adapted to move on a worm driven by the motor.

In a particularly preferred embodiment of the present invention, the motor is mounted on a cradle, which in turn is mounted in the frame for rocking about an axis substantially perpendicular to the longitudinal axis of the pole.

In a first variation of this preferred embodiment, the motor is an electric motor capable of turning in both directions.

In another variation of this embodiment, the motor consists of an internal combustion engine carried on the cradle by means of a support mounted for pivoting about an axis substantially perpendicular to the pivot axis of the cradle. The drive shaft is disposed substantially parallel to the axis of the worm and is connected via a centrifugal clutch to a small pulley and a roller cooperating with a larger pulley which is provided with a driving surface. The second pulley is disposed on the cradle and is connected to the worm for the purpose of rotationally driving the latter. Known Bowden-type controls control the rocking of the support in order to either tension the belt between the large pulley and the small pulley; or to bring the roller into contact with the driving surface of the pulley.

The frame is preferably pivotally mounted on a platform adapted to be anchored in the ground and intended for supporting the operator.

The blade mounted at the free end of the stem can, of course, be controlled in a manner known per se in a rocking movement intended to unload it. It is preferable for this blade to be fastened to a lever pivotally mounted on the corresponding end of the stem. The opposite end of the blade is connected to a first rod, which in turn is connected to a second rod by means of a lever pivotable on the stem. The second rod is substantially parallel to the pole and is driven in a reciprocating movement by a pedal in the form of a lever pivoted on the frame. A return spring is preferably provided for returning the pedal to its starting position after each operation.

It will be appreciated that the apparatus in accordance with the present invention is particularly simple and makes use of a small number of mechanical parts. The arrangement of the motorized shovel of this invention is essentially different from that of a mechanical shovel of the prior art. It will also be noted that the frame is freely pivotable on the platform and that the shovel is partly operated by manpower, whereas in the prior art, the force for the digging action of the shovel or for loading it resulted solely from the installed motive power. The judicious arrangement of the various mechanical components in accordance with the present invention makes it possible to obtain a simple mechanical shovel which is light and therefore portable; and which advantageously combines the operator's force, suitably amplified by levers, with a relatively slight motive power.

The above discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DESCRIPTION OF THE PREFERRED EMBODIMENT

Figure 1:
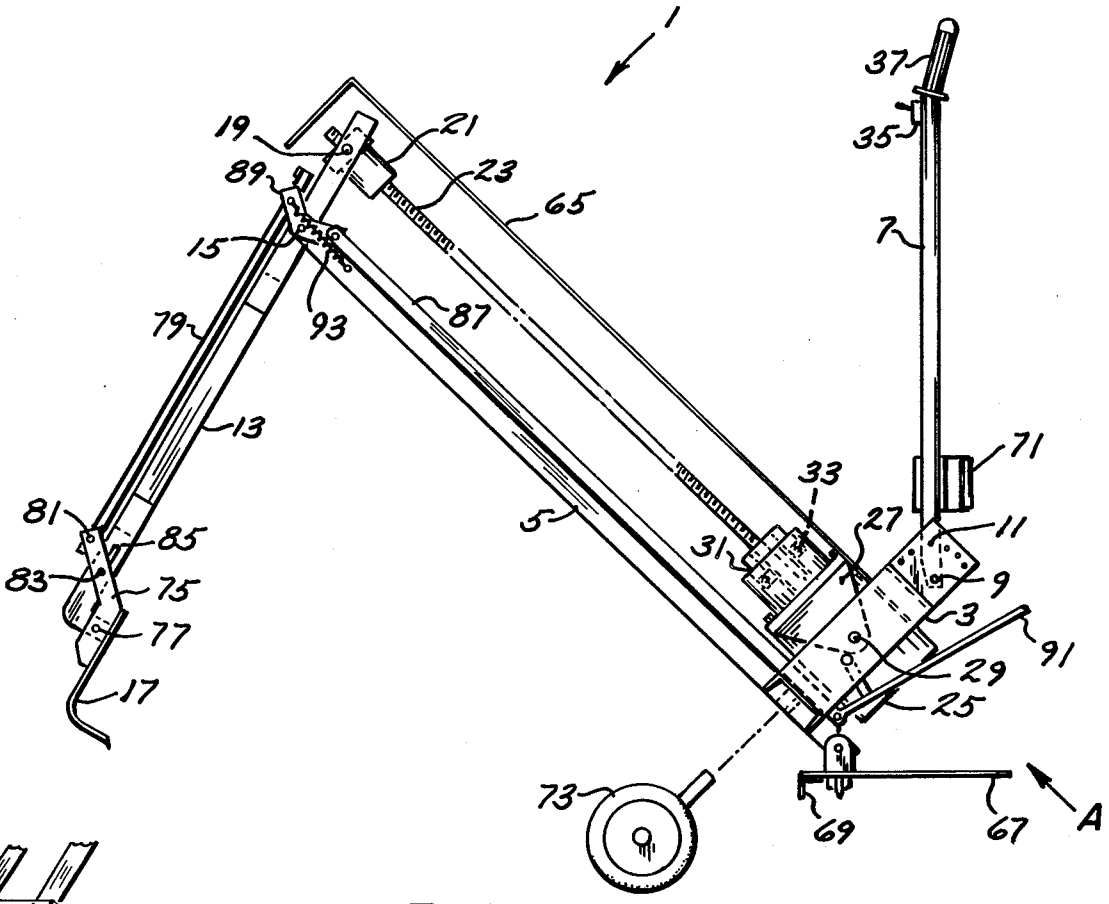
FIG. 1 is a schematic side elevation view of the motorized shovel in accordance with the present invention.

The motorized shovel in accordance with the present invention is shown generally at 1 and comprises a frame 3 equipped with a pole 5 fastened to frame 3 (for example, by welding). Frame 3 is also provided with two handles 7 and 7'. The handles are fastened to frame 3, but can assume adjustable angular positions with the aid of a pivot pin 9 and a catch 11 securing handles 7, 7' in different angular positions.

The articulated arm of the portable motorized shovel of the present invention is composed of pole 5 and a shovel stem 13 pivoted on the free end of the pole 5 by means of a pivot 15. One end of stem 13 carries the preferably rockable blade 17. The other end of stem 13 (extending beyond the pivot point 15 on pole 5), is connected by a pivot 19 to a nut 21 adapted to move on a worm 23 driven by a motor 25 disposed on frame 3.

In the illustrated embodiment, motor 25 is fixed on a cradle 27 pivotally mounted in frame 3 by means of pivot pin 29. The rotation of motor 25, and consequently the rotation of the worm in one direction or the other, entails a corresponding displacement of nut 21; and therefore the pivoting of stem 13 in relation to pole 5.

In a preferred embodiment, the movement transmission means consists of a ball worm and a ball nut. The connection between the drive shaft of motor 25 and ball worm 23 is preferably made by a connecting sheath 31 fastened to the drive shaft and guided by one or more ball bearings 33 held captive in rocking cradle 27.

The rotation of ball worm 23 is controlled from handles 7, 7' with the aid of one or more control levers 35 positioned near the handle grips 37.

In a first embodiment of the present invention, motor 25 is an electric motor capable of turning in both directions. In this case, control lever 35 consists of a lever assuming three positions: forward, reverse and stop.

Figure 4:
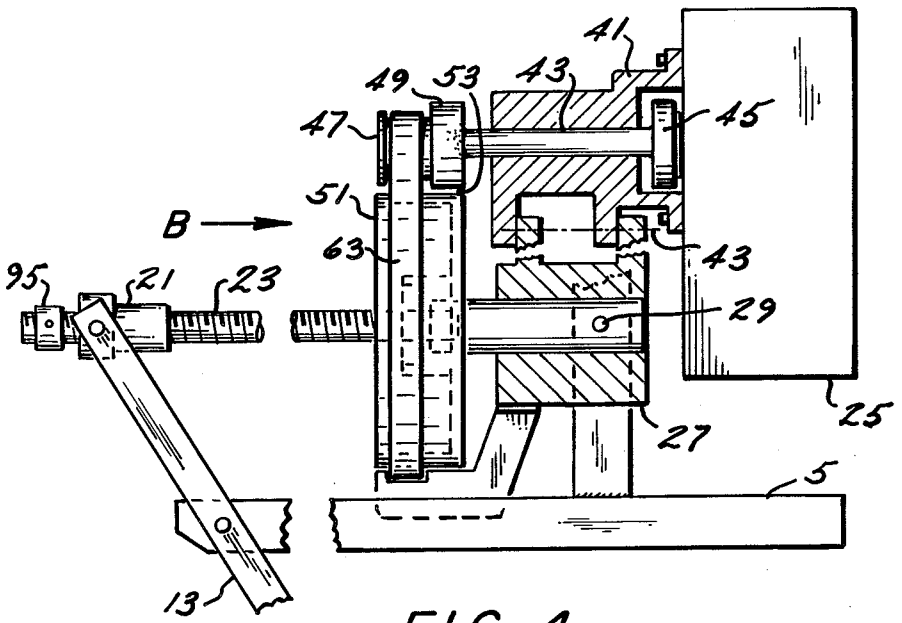
FIG. 4 schematically illustrates another variation of the shovel in accordance with the present invention.

In another embodiment of this invention, motor 25 consists of an internal combustion engine 25 (see FIG. 4) disposed on cradle 27 with the aid of a support 41 mounted for pivoting on an axis 43 which is substantially perpendicular to the pivot axis 29 of cradle 27. The drive shaft 43 is disposed substantially parallel to the axis of worm 23 and is connected, with the aid of a centrifugal clutch 45, to a small pulley 47 and a roller 49 cooperating with a larger pulley 51 which is provided with a driving surface 53. Pulley 51 is disposed on cradle 27 and connected to worm 23 for the rotational driving of the worm. Bowden controls 55 and 57 extend down from handles 7, 7' and are connected to support 41, with the interposition of springs 59, 61. Controls 55 and 57 control the rocking of support 41 for the purpose of either tensioning a belt 63 between the large pulley 51 and the small pulley 47; or bringing roller 49 into contact with driving surface 53 of pulley 51.

In this way a means of driving worm 23 in both directions of rotation is obtained; in addition to a neutral position in which the belt slips and the roller is not in contact with the large pulley.

It is also possible to provide a cover 65 for protecting the ball worm assembly and/or motor 25.

Frame 3 is preferably pivoted on a platform 67 provided with spikes 69 for anchoring to the ground.

The operation of the shovel machine of this invention is controlled with the aid of handles 7, 7' fastened to frame 3. Preferably, the handles are made so as to be folded back against cover 65 to provide them with a handle grip 71 disposed at a suitable point, thus enabling the motorized shovel to be easily transported in the form of a suitcase.

It is also possible to provide a wheel 73 mounted on frame 3, opposite the handles 7, 7'. In this way, the machine can be moved in the form of a wheelbarrow.

As shown in FIG. 1, blade 17 is fixed to stem 13 by a lever 75 in such a manner as to enable it to be suitably positioned for penetration into the ground under good conditions or for preventing unloading when it is lifted. Lever 75 pivots about the pivot axis 77 and is operated by a first rod 79 connected thereto by a pivot pin 81. A catch 83 may be provided to lock the blade in a fixed position relative to stem 13, (needed for example, in the case of backfilling). A stop 85 is provided to limit the rocking movement of blade 17.

First rod 79 is connected to a second rod 87 by means of a lever 89 pivoting on stem 13 at a pivot point 15. The second rod 87 is operated by a pedal 91 in the form of a lever.

Figure 3:
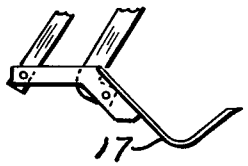
FIG. 3 is a partial view showing another position of the blade.
Figure 2:
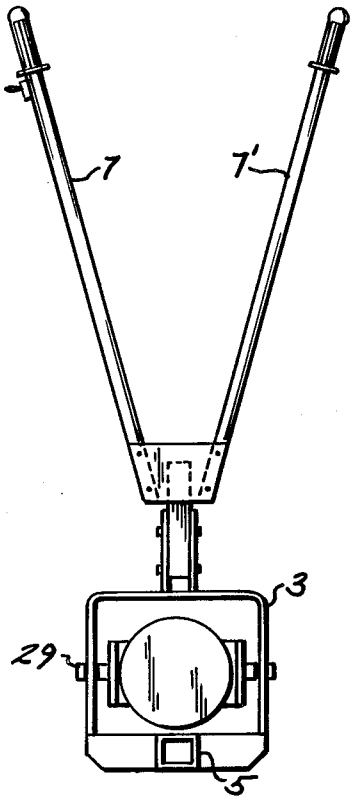
FIG. 2 is a schematic bottom view of the portable shovel, viewed in the direction A in FIG. 1.
Figure 5:
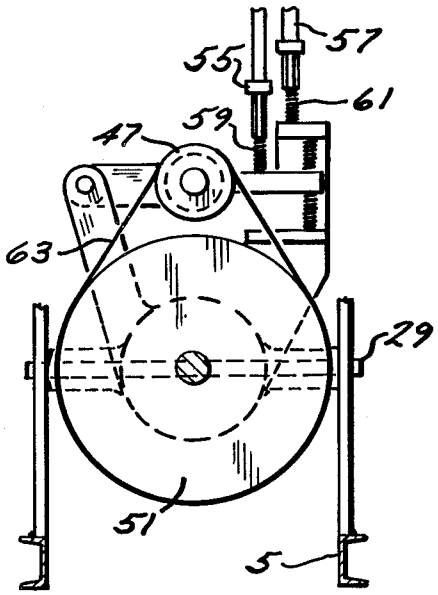
FIG. 5 is a view in the direction B in FIG. 4.

When blade 17 has been filled and brought back against the bottom of pole 5, a spring 93 brings about the rocking of lever 75 (see FIG. 3), which with the aid of rod 79, raises blade 17. When the loaded shovel has been lifted above the ground, action on the pedal 91 rocks blade 17 to empty it and also to return it to the working position for the next operation.

During the downward movement of blade 17 towards the ground and into the ground, blade 17 remains fixed relative to its stem 13. During this movement, pedal 91 is lifted back automatically.

Figure 6:
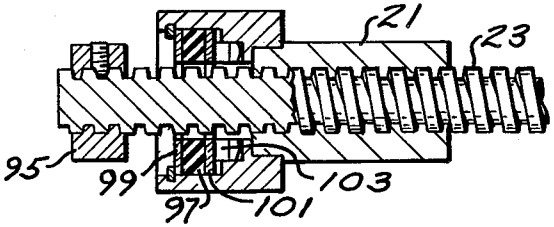
FIG. 6 is a cross-sectional longitudinal view through the ball nut.

Referring now to FIG. 6, an enlarged view in longitudinal section is shown of the ball nut. Ball worm 23 is preferably provided at its top end with a rigidly fixed stop 95. Nut 21 of ball worm 23 is provided with a flexible washer 97 for damping the repeated impact of stop 95 against nut 21. Two metal washers 99 and 101 protect damper 97. A needle-type stop 103 facilitates the reversal of the direction of operation, despite a not negligible approach force between the nut and its stops. A similar device is provided at the other end of ball worm 23. The damper washer 97 is then inserted in the hub of the large pulley 51 or in the sheath 31.

The motorized shovel of the present invention is relatively simple in its construction, and makes it possible to reduce, or even to eliminate, the considerable laborious force supplied by an operator when working with a shovel or pick.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Portable motorized shovel comprising frame means articulated to an arm, the frame means supporting a motor and being provided with handles and further including:

said articulated arm comprising a pole having opposed first and second ends, said first end of said pole being fastened to said frame means and said second end of said pole being pivotally connected at a pivot point to a shovel stem, a first end of said stem including a rockable blade and a second opposite end of said stem extending beyond said pivot point on said pole and being pivotally connected to a nut which is movable on a worm driven by said motor.

2. Shovel according to claim 1 wherein:

said worm comprises a ball worm and said nut comprises a ball nut.

3. Shovel according to claim 1 wherein:

said motor is mounted on a cradle, said cradle being mounted in said frame means for rocking about an axis which is substantially perpendicular to the longitudial axis of said pole.

4. Shovel according to claim 1 wherein:

said motor comprises an electric motor capable of turning in both directions of rotation, said motor having a drive shaft connected to said worm by sheath means mounted on bearings.

5. Shovel according to claim 3 wherein:

said motor comprises an internal combustion engine carried on said cradle by support means mounted for pivoting about an axis substantially perpendicular to the pivot axis of said cradle, said motor having a drive shaft which is disposed substantially parallel to the axis of said worm and being connected via clutch means to a first pulley and a roller cooperating with a second pulley, said second pulley having a driving surface, said second pulley being disposed on said cradle and being connected to said worm for rotationally driving said worm; and control means for controlling the rocking of said support means in order to either tension a belt between said second pulley and said first pulley, or to bring said roller into contact with said driving surface of second pulley.

6. Shovel according to claim 5 wherein:

said second pulley has a larger diameter than said first pulley.

7. Shovel according to claim 1 wherein:

said frame means is pivotally mounted on a platform having anchoring spikes.

8. Shovel according to claim 1 wherein:

said blade is fastened to a first lever and pivotally mounted to said first end of said stem, said first lever also being connected to a first rod, said first rod being connected to a second rod by means of a second lever pivotally mounted on said stem, said second rod being substantially parallel to said pole and being driven in a reciprocating movement by a pedal pivoted on said frame means.

9. Shovel according to claim 8 including:

return spring means for returning the pedal to its starting position after each operation.

10. Shovel according to claim 10 wherein:

said nut comprises a ball nut which is provided at at least one end with a flexible washer sandwiched between a pair of metal washers and a stop means.

11. Shovel according to claim 1 wherein:

said frame means includes a detachable wheel.

12. Shovel according to claim 1 wherein:

said stem is folded back against said pole and said handles are folded back substantially parallel to said pole; and said handles each including a handle grip.

* * * * *